US010274196B2

(12) United States Patent
Nakata et al.

(10) Patent No.: US 10,274,196 B2
(45) Date of Patent: Apr. 30, 2019

(54) COMBUSTION CONTROLLING SYSTEM

(71) Applicant: Azbil Corporation, Tokyo (JP)

(72) Inventors: Tomoya Nakata, Tokyo (JP); Yuichi Kumazawa, Tokyo (JP); Katsumi Morikawa, Tokyo (JP)

(73) Assignee: Azbil Corporation, Tokyo (JP)

( * ) Notice: Subject to any disclaimer, the term of this patent is extended or adjusted under 35 U.S.C. 154(b) by 161 days.

(21) Appl. No.: 15/468,784

(22) Filed: Mar. 24, 2017

(65) Prior Publication Data

US 2017/0276351 A1 Sep. 28, 2017

(30) Foreign Application Priority Data

Mar. 28, 2016 (JP) ..... 2016-063544

(51) Int. Cl.
*F23N 1/00* (2006.01)
*F23N 5/24* (2006.01)
*F27D 19/00* (2006.01)

(52) U.S. Cl.
CPC ..... *F23N 1/005* (2013.01); *F23N 1/00* (2013.01); *F23N 5/24* (2013.01); *F23N 5/245* (2013.01); *F27D 19/00* (2013.01)

(58) Field of Classification Search
CPC ..... F23N 1/00; F23N 5/24
USPC ..... 431/60
See application file for complete search history.

(56) References Cited

U.S. PATENT DOCUMENTS 5,049,063 A * 9/1991 Kishida ..... F23N 1/022 431/25
8,144,718 B2 * 3/2012 Schwenkel ..... G05B 19/042 370/408
10,139,107 B2 * 11/2018 Nakata ..... F23N 5/242
2014/0212821 A1 * 7/2014 Banu ..... F23N 5/242 431/6
2018/0224122 A1 * 8/2018 Mimura ..... F23K 5/007

FOREIGN PATENT DOCUMENTS

CN 101111807 A 1/2008
JP H11-218034 A 8/1999

OTHER PUBLICATIONS

Combined Chinese Office Action and Search Report dated Oct. 22, 2018 in Chinese Patent Application No. 201710191874.3 (with English translation of Category of Cited Documents), citing documents AA and AO therein, 8 pages.

* cited by examiner

*Primary Examiner* — Gregory L Huson
*Assistant Examiner* — Nikhil P Mashruwala
(74) *Attorney, Agent, or Firm* — Oblon, McClelland, Maier & Neustadt, L.L.P.

(57) ABSTRACT

A combustion controlling system according to the present invention provides a signal path for transmitting the normal combustion signal SB output from the master device to the transmission line through cascade-connected slave devices. Then, the combustion controlling system determines whether each of the slave devices outputs the normal combustion signal SB to the subsequent device based on whether there is a flame of the corresponding burner, or not, during the combustion of burners, and the master device closes a safety shutoff valve on the condition that an input of a normal combustion signal SBo from a transmission line is stopped.

7 Claims, 11 Drawing Sheets

COMBUSTION CONTROLLING SYSTEM

CROSS-REFERENCE TO RELATED APPLICATION

This application claims priority to Japanese Patent Application No. 2016-063544 filed Mar. 28, 2016. This application is incorporated herein by reference in its entirety.

TECHNICAL FIELD

The present invention relates to a combustion controlling system, and more particularly to a multi-burner system for collectively controlling the supply of a fuel to a plurality of burners with a common safety shutoff valve.

BACKGROUND

In general, in combustion furnaces typified by industrial furnaces such as a steel furnace, a heating furnace and a deodorizing furnace, a combustion control is performed by a combustion controlling system while monitoring a combustion state of a burner disposed in the combustion furnace, a furnace temperature, a pressure of a combustion air, and a pressure of a fuel to be supplied to the burner, to thereby ensure the safety of combustion.

For example, in the combustion controlling system, in a state in which the combustion of the burner is abnormal and a flame has disappeared or a state close to that state (hereinafter referred to as "flame failure"), a control is performed so that a safety shutoff valve is closed within a flame extinction safety time to stop the supply of a fuel to the burner based on a safety standard related to industrial combustion furnaces (EN 298: 2012, EN 746-2: 2010). In that case, the flame extinction safety time is a time to start with a signal indicating that the flame has disappeared and to end with a signal indicating that the safety shutoff valve of the gas fuel supply is closed (refer to JIS B 8407).

As the combustion controlling system, for example, as disclosed in Japanese Unexamined Patent Application Publication No. H11-218034, there is a multi-burner system that controls combustion of a plurality of burners installed in a common combustion chamber. In the present specification, the combustion chamber means a space in which combustion is controlled under a condition (parameter) where a temperature, a pressure or the like is the same, and is also called "zone" below.

In general, the multi-burner system employs a star type device configuration including a burner controller provided corresponding to each burner and a safety controlling device for controlling each burner controller. For that reason, a communication between the respective burner controllers is not performed directly but indirectly through a safety controlling device on an upstream side.

SUMMARY

By the way, in the multi-burner system, in order to realize the safe combustion of the multiple burners, it is particularly important to control the supply of the fuel to the respective burners. Therefore, in the conventional multi-burner system, as a highly safe control technique, a control technique in which a safety shutoff valve is provided for each of branch pipes branched from a main fuel pipe for each burner, and each safety shutoff valve is opened and closed by a corresponding burner controller, to thereby control the supply and shutoff of the fuel to each burner on a burner-by-burner basis.

On the other hand, in recent years, as another technique for controlling the supply of the fuel in the multi-burner system, a control technique in which a single safety shutoff valve common to a main pipeline of the fuel is provided, and the safety shutoff valve is opened and closed by one burner controller that functions as a master, to thereby collectively control the supply and the shutoff of the fuel to each burner at the same time is desired due to an insufficient installation space of equipment such as a safety shutoff valve and economic reasons.

However, in the latter control technique, as will be described below, it has been clarified by the investigation of the present inventors that there is a problem at the time of the flame failure of the burner.

For example, according to the former control technique, when the burner has caused a flame failure, since the burner controller monitoring the burner closes the corresponding safety shutoff valve at its own discretion, the supply of the fuel to the burner that has caused the flame failure within the flame extinction safety time can be immediately stopped.

On the other hand, according to the latter control technique, when a burner managed by the burner controller other than the master has caused the flame failure, the burner controller managing the burner notifies the upstream side safety controlling device that the abnormality has occurred, and the safety controlling device that has received the notification gives an instruction to the master burner controller and the burner controller of the master receiving the instruction closes the safety shutoff valve to stop the combustion of all the burners.

As described above, because a communication between the burner controller that has detected an abnormality and the burner controller of the master is indirectly performed through the safety controlling device, a time lag occurs until all of the burners are stopped after the abnormality has been detected. Therefore, there is a risk that the safety shutoff valve cannot be closed within the flame extinction safety time, and the safety standard cannot be satisfied.

The present invention has been made in view of the above problems, and an object of the present invention is to improve a responsiveness of control to a safety control valve at the time of burner flame failure in a multi-burner system for controlling the supply of fuel to a plurality of burners by one safety shutoff valve.

A combustion controlling system according to the present invention includes a master device that controls opening and closing of a common safety shutoff valve for collectively switching supply and shutoff of a fuel to a plurality of burners and generates a predetermined signal; a plurality of slave devices that are provided corresponding to the respective burners, determine whether there is aflame in the respective burners, or not, control an ignition of the respective burners, and output the input predetermined signal when it is determined that there is the flame after the ignition of the respective burners, and output no input predetermined signal when it is determined that there is no flame after the ignition of the respective burners; and a transmission line that is connected to the master device for transmitting the predetermined signal, wherein the plurality of slave devices are connected in cascade, when all of the plurality of slave devices determine that there is the flame after the ignition of the respective burners, the predetermined signals input to an initial-stage slave device from the master device are sequentially output and the predetermined signal is output from a final-stage slave device to the transmission line, when any one of the plurality of cascaded slave devices determines that there is no flame after the ignition of the respective burners, the predetermined signal is not output from the final-stage slave device to the transmission line, and the master device controls opening and closing of the safety shutoff valve based on whether the predetermined signal is input from the transmission line, or not.

In the combustion controlling system, the master device may close the safety shutoff valve when the input of the predetermined signal is stopped from a state where the predetermined signal is input from the transmission line.

In the combustion controlling system, in the case where the burners are ignited from a state in which none of the burners is ignited, the master device may close the safety shutoff valve when the predetermined signal is not input from the transmission line within a predetermined period after the safety shutoff valve has been opened, and may keep the safety shutoff valve open when the predetermined signal is input from the transmission line within the predetermined period.

The combustion controlling system may further include a burner whose combustion is controlled by the master device, in which the master device may output the predetermined signal to the initial-stage slave device connected in cascade when it is determined that there is the flame after the burner to be controlled has been ignited, and may output no predetermined signal when it is determined that there is no flame after the burner to be controlled has been ignited.

In the combustion controlling system, the master device may include a first flame determining portion that determines whether there is a flame of the burner to be controlled, or not; a signal generating portion that generates and outputs the predetermined signal when it is determined that there is the flame by the first flame determining portion and generates no predetermined signal when it is determined that there is no flame by the first flame determining portion; a signal detecting portion that detects an input of a normal combustion signal from the transmission line; a control mode setting portion that switches a control mode of the burner between an ignition mode for igniting the burner from a state in which none of the burners is ignited and a normal mode in which the burner is normally ignited; a timer that counts an allowable time during which fuel can be supplied to the burners; and a safety shutoff valve controlling portion that controls the opening and closing of the safety control valve based on a detection result of the signal detecting portion and the control mode, and when the ignition mode is set, the safety shutoff valve controlling portion may close the safety shutoff valve after the allowable time has elapsed if the input of the predetermined signal is not detected by the signal detecting portion until the allowable time elapses after the safety shutoff valve has been opened, and may keep the safety shutoff valve open if the input of the predetermined signal is detected by the signal detecting portion until the allowable time elapses.

In the combustion controlling system, the safety shutoff valve controlling portion may close the safety shutoff valve without waiting for the allowable time to elapse if the input of the predetermined signal is not detected by the signal detecting portion when the normal mode is set.

In the combustion controlling system, the slave device may include a second flame determining portion that determines whether there is a flame of the corresponding burner, or not; a signal outputting portion that outputs the input predetermined signal if it is determined that there is the flame by the second flame determining portion and outputs no input predetermined signal if it is determined that there is no flame by the second flame determining portion; and an ignition controlling portion that controls ignition of the corresponding burner based on a determination result of the second flame determining portion.

In the above description, as an example, components on the drawings corresponding to components of the present invention are represented by reference numerals in parentheses.

As described above, the present invention can improve the responsiveness of control to the safety control valve at the time of burner flame failure in the multi-burner system for collectively controlling the supply of the fuel to the plurality of burners by one common safety shutoff valve.

DETAILED DESCRIPTION

Examples of the present invention will be described below with reference to the drawings.

(Configuration of Combustion Controlling System According to First Example)

Figure 1:
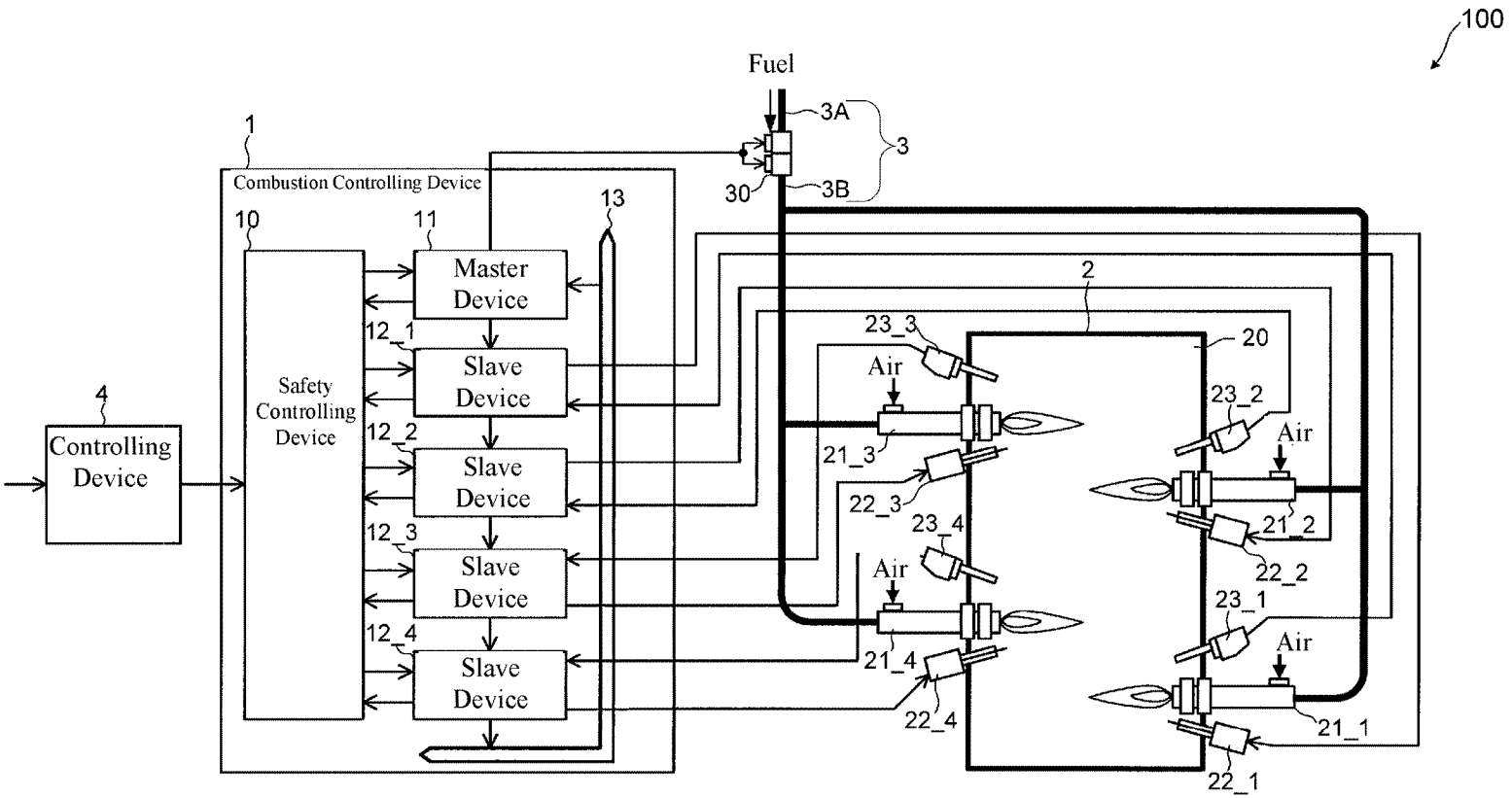
FIG. 1 is a diagram illustrating a configuration of a combustion controlling system according to an example.

FIG. 1 is a diagram illustrating a configuration of a combustion controlling system having a combustion controlling device according to the present example.

A combustion controlling system 100 illustrated in the figure is a multi-burner system. Examples of the combustion controlling system 100 include a system for controlling a small industrial combustion furnace such as a deodorizing furnace and a heating furnace, and a system for controlling a large industrial combustion furnace such as a steel furnace in a plant or the like.

Specifically, the combustion controlling system 100 includes a combustion furnace 2 having one combustion chamber 20, a combustion controlling device 1, a controlling device 4, and a fuel flow channel 3.

The combustion chamber 20 is equipped with n (n is an integer of 2 or more) burners 21_1 to **21_*n*, ignition devices (igniters, IG) 22_1 to 22_*n* provided corresponding to the respective burners 21_1 to 21_*n*, flame detectors (SEN) 23_1 to 23_*n* provided corresponding to the respective burners 21_1 to 21_*n***, and a device necessary for combustion control such as a temperature sensor.

In the present example, n=4 is set as an example, four burners 21_1 to 21_4, four flame detectors 23_1 to 23_4, and four ignition devices 22_1 to 22_4 are provided in the combustion chamber 20. However, the value of "n" is not limited to that value. In FIG. 1, illustration of other devices necessary for the combustion control such as the temperature sensor and the like is omitted.

The burners 21_1 to 21_4 (also simply referred to as "burners 21" in a generic term) are devices that heat an interior of the combustion chamber 20. In the present example, an example will be described in which the burners 21_1 to 21_4 are burners of a direct ignition type directly igniting a main burner without the provision of a pilot burner.

The burners 21_1 to 21_4 are fired by ignition with the use of the ignition devices 22_1 to 22_4 provided corresponding to the respective burners.

The ignition devices 22_1 to 22_4 (also simply referred to as "ignition devices 22" in a generic term) each include, for example, an ignition transformer and an ignition electrode rod (spark rod) connected to a secondary side interconnection of an ignition transformer. The ignition devices 22_1 to 22_4 ignite the respective burners 21_1 to 21_4 by generating a high voltage of, for example, several kV to several tens of kV on the spark rod according to a control signal from the combustion controlling device 1 to be described later.

The flame detectors 23_1 to 23_4 (also simply referred to as "flame detectors 23" in a generic term) are devices that are provided corresponding to the respective burners 21_1 to 21_4, and detect whether there is a flame in the respective burners, or not. The respective flame detectors 23_1 to 23_4 output flame detection signals indicative of whether there is the flame, or not.

The fuel flow channel 3 is a flow channel for supplying the fuel to the combustion furnace 2. The fuel flow channel 3 includes a main flow channel 3A to which the fuel is supplied from an outside and a branch flow channel 3B branched into a plurality of flow channels from the main flow channel 3A. A safety shutoff valve 30 is installed in the main flow channel 3A, and the branch flow channel 3B is connected to each of the burners 21_1 to 21_4.

In this case, the fuel may be, for example, gas or oil (liquid), and the fuel type is not particularly limited.

The safety shutoff valve 30 is a device for collectively switching the supply and shutoff of the fuel with respect to the plurality of burners 21_1 to 21_4. When the safety shutoff valve 30 is open, the fuel is delivered from the main flow channel 3A to the branch flow channel 3B, and the fuel is supplied to the respective burners 21_1 to 21_4. When the safety shutoff valve 30 is closed, an inflow of the fuel from the main flow channel 3A to the branch flow channel 3B is shut off, and no fuel is supplied to the burners 21_1 to 21_4.

As illustrated in FIG. 1, for example, the safety shutoff valve 30 has a configuration in which two shutoff valves are used as a set to perform double shutoff, and is disposed in a main flow channel 3A.

Although not shown, the combustion controlling system 100 is provided with an air flow channel for supplying air to the combustion furnace 2 aside from the fuel flow channel 3, and the air discharged from a blower is supplied to the respective burners 21_1 to 21_4 through the air flow channel.

The controlling device 4 is a device on an upstream side in the combustion controlling system 100, for performing a comprehensive control of the combustion furnace 2. The controlling device 4 gives the combustion controlling device 1 an instruction (hereinafter referred to as "combustion request") for combustion in the combustion chamber 20, and a stop request for the operation of the overall combustion furnace 2 according to an input operation from an operator (user) or the like.

As the controlling device 4, a control board integrated with an operation input means for inputting a user's operation such as an operation button, a lever, and a keyboard, a display means for displaying information such as a monitor, and a control means for outputting an instruction and the like to the combustion controlling device 1 can be exemplified. In addition, for example, when a network controlling system in which the combustion controlling device 1, the monitor, a central management device, and the like are connected to each other through a network is configured, the central management device that issues instructions to the combustion controlling device 1 functions as the controlling device 4.

The combustion controlling device 1 is a device for controlling the combustion of the burner 21 in the combustion chamber 20 according to a combustion request from the controlling device 4 or the like. As illustrated in FIG. 1, the combustion controlling device 1 includes a safety controlling device 10, a master device 11, a transmission line 13, a plurality of slave devices 12_1 to **12_*n* cascaded between the master device 11 and the transmission line 13**.

The safety controlling device 10 monitors a combustion state of the burners 21, a state of each limit/interlock (not shown), and so on in order to perform safe operation of the combustion controlling system 100, that is, prevent explosion of the combustion furnace 2, and so on, to thereby instruct the master device 11 and the slave devices 12_1 to 12_4 to permit or refuse the operation of the burners 21 in the combustion chamber 20.

For example, the safety controlling device 10 generates signals indicative of the permission or no permission of the operation of each burner on the basis of a combustion request and a shutoff request of each burner from the controlling portion 4, and flame determination information, abnormality detection information, and so on input from each of burner controllers 11, 12_1 to 12_4, and supplies the signals to the master device 11 and the slave devices 12_1 to 12_4. As a result, the safety controlling device 10 controls the operation (the supply and stop of the fuel to the respective burners, etc.) of the respective burners 21_1 to 21_4 through the master device 11 and the slave devices 12_1 to 12_4.

The safety controlling device 10 can be exemplified by a limit interlock module for monitoring a limit interlock manufactured on the basis of safety standard (for example, safety general rules of the industrial combustion furnace JIS B 8415, etc.) related to the industrial combustion furnaces, or a programmable logic controller (so-called safety PLC) that configures a dedicated software complying with the safety general rules.

The master device 11 is a device for controlling the opening and closing of the safety shutoff valve 30.

After the completion of ignition preparation of the burners, the master device 11 generates a predetermined signal and gives the predetermined signal to a cascade-connected initial-stage slave device 12_1. In addition, the master device 11 determines whether the predetermined signal has been returned from the transmission line 13 through the cascade-connected slave devices 12_1 to 12_4, or not, to control the opening and closing of the safety shutoff valve 30. Hereinafter, the master device 11 will be described in detail.

Figure 2:
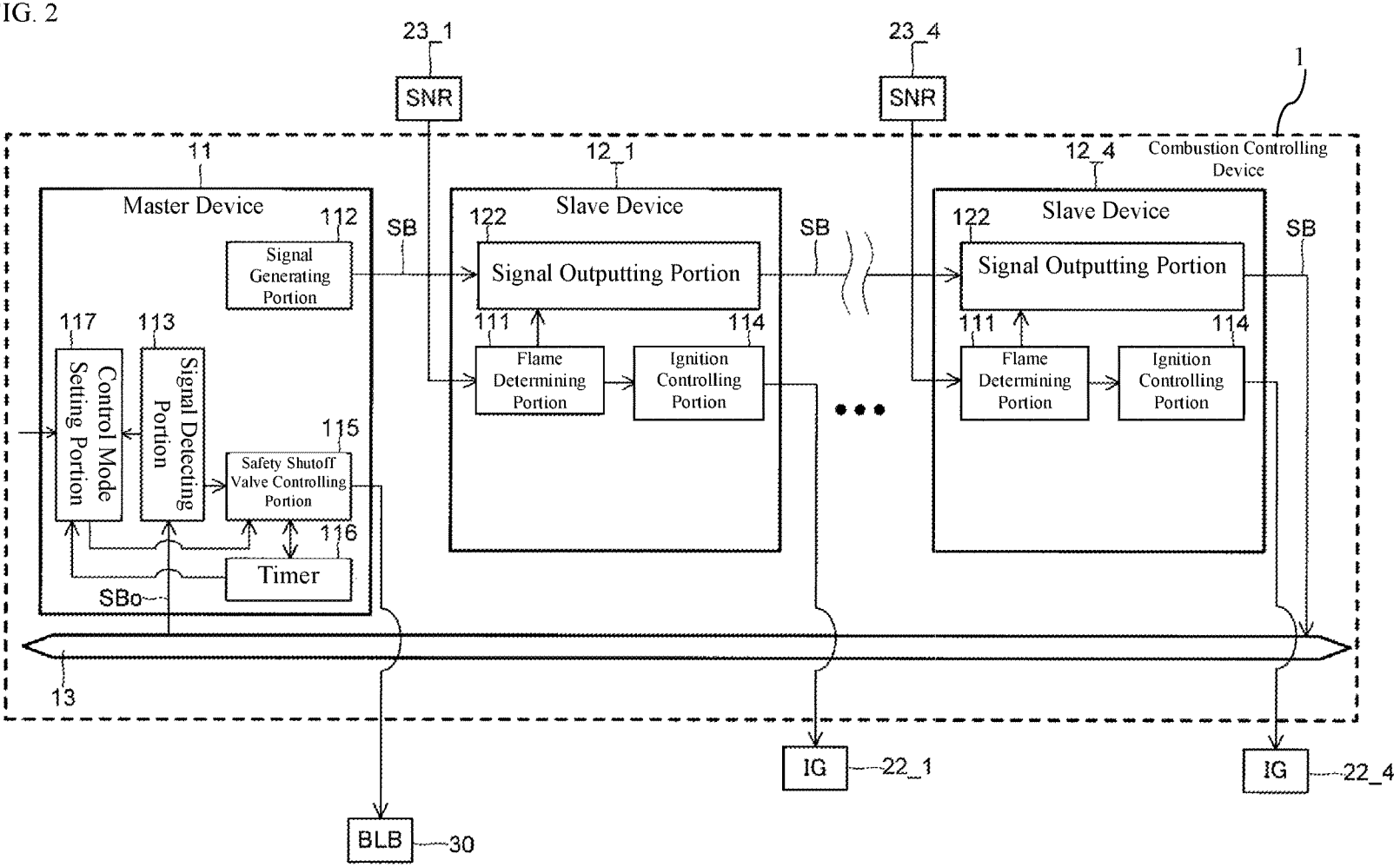
FIG. 2 is a diagram illustrating a configuration of a master device and a slave device in the combustion controlling system according to the example.

FIG. 2 is a diagram illustrating configurations of a master device and slave devices in the combustion controlling system according to the example. In FIG. 2, illustration of the safety controlling device 10 is omitted.

As illustrated in the figure, the master device 11 includes a signal generating portion 112, a signal detecting portion 113, a control mode setting portion 117, a timer 116, and a safety shutoff valve controlling portion 115. Those function portions are realized by hardware including, for example, a processor, a clock circuit, a communication circuit, a memory device, a digital input/output circuit, an analog input/output circuit, a power electronics circuit, and the like, and a program for realizing various functions in cooperation with those hardware.

The signal generating portion 112 is a function portion that generates a predetermined signal. In the present example, a predetermined signal will be described as "normal combustion signal SB".

For example, upon receiving a combustion request from the safety controlling device 10, the signal generating portion 112 generates a normal combustion signal SB and supplies the normal combustion signal SB to the cascade-connected initial-stage slave device 12_1.

In this example, a signal format of the normal combustion signal SB is not particularly limited. For example, in the present example, it is assumed that the normal combustion signal SB is a pulse signal, but the normal combustion signal SB may be a 1-bit signal of high level or low level or a signal of multiple bits.

As will be described in detail later, the normal combustion signal SB output from the signal generating portion 112 is input to the transmission line 13 through the cascade-connected slave devices 12_1 to 12_4, and again input to the master device 11 from the transmission line 13. In the present example, the normal combustion signal until output to the transmission line 13 is denoted as "SB", and the normal combustion signal output to the transmission line 13 is denoted as "SBo".

The signal detecting portion 113 is a function portion that detects the input of the normal combustion signal SBo from the transmission line 13.

The control mode setting portion 117 is a function portion for setting a control mode of the burners 21. The control mode setting portion 117 sets any one of an ignition mode for igniting the burners 21 from a state in which none of the burners 21 is ignited, a normal mode in which all of the burners 21 are normally ignited, and a standby mode in which ignition of the burners is not performed as the control mode of the burners 21.

Specifically, the control mode setting portion 117 sets the control mode to the standby mode in the initial state immediately after the combustion controlling system 100 has been activated, and thereafter sets the control mode to the ignition mode, for example, after the combustion request is output from the controlling device 4 through the safety controlling device 10. Then, the control mode setting portion 117 ignites the burners 21_1 to 21_4 of the combustion controlling system 100, and after all of the burners 21_1 to 21_4 have been normally ignited, the control mode setting portion 117 sets the control mode to the normal mode.

For example, when an input of the normal combustion signal SBo from the transmission line 13 is detected by the signal detecting portion 113 after a lapse of a predetermined allowable time Ts to be described later in the ignition mode, the control mode setting portion 117 switches the control mode to the normal mode. On the other hand, in the ignition mode, if the input of the normal combustion signal SBo from the transmission line 13 is not detected even after the allowable time Ts has elapsed, the control mode is switched from the ignition mode to the standby mode.

The timer 116 counts a maximum allowable time Ts at which the supply of the fuel to the burner 21 is permitted in the absence of flame, that is, a safety time (JIS B 0113). For example, in the ignition mode, the safety shutoff valve controlling portion 115 instructs the timer 116 to count the allowable time Ts according to a timing of opening the safety shutoff valve 30. Thereafter, upon the completion of counting the allowable time Ts, the timer 116 notifies the safety shutoff valve controlling portion 115 and the control mode setting portion 117 of this fact.

In the present example, as an example, it is assumed that an ignition period (ignition trial period) in which ignition operation is performed and the allowable time Ts are the same.

The safety shutoff valve controlling portion 115 controls the opening and closing of the safety shutoff valve 30 based on the detection result of the signal detecting portion 113. Specifically, when the input of the normal combustion signal SBo is detected by the signal detecting portion 113, the safety shutoff valve controlling portion 115 opens the safety shutoff valve 30. When the input of the normal combustion signal SBo is not detected by the signal detecting portion 113, the safety shutoff valve controlling portion 115 closes the safety shutoff valve 30.

More specifically, when the control mode is set to the ignition mode, the safety shutoff valve controlling portion 115 closes the safety shutoff valve 30 after the allowable time Ts has elapsed if the input of the normal combustion signal Sbo has not been detected by the signal detecting portion 113 until the allowable time Ts elapses after the safety shutoff valve 30 has been opened. If the input of the normal combustion signal SBo has been detected until the allowable time Ts elapses, the safety shutoff valve controlling portion 115 keeps the safety shutoff valve 30 open.

When the control mode is set to the normal mode, if the input of the normal combustion signal SBo is not detected by the signal detecting portion 113, the safety shutoff valve controlling portion 115 closes the safety shutoff valve 30 without waiting for the elapse of the allowable time Ts.

The transmission line 13 is a line that is connected to the master device 11 for transmitting the normal combustion signal SB. For example, as described above, when the normal combustion signal SB is a pulse signal, the transmission line 13 may be configured by a dedicated line for 1-bit transmission, or when the normal combustion signal SB is a multi-bit signal, the transmission line 13 may be a bus having a plurality of signal lines.

The slave devices 12_1 to 12_4 (also simply referred to as "slave devices 12" in a general term) are burner controllers that are provided corresponding to the respective burners 21_1 to 21_4, determine whether there is a flame of the respective burners, or not, and controls the ignition of the respective burners. Each of the slave devices 12_1 to 12_4 is connected in cascade between the master device 11 and the transmission line 13 so as to provide a signal path for transmitting the normal combustion signal SB output from the master device 11 to the transmission line 13.

As illustrated in FIG. 2, each of the slave devices 12 includes a flame determining portion 111, a signal outputting portion 122, and an ignition controlling portion 114. Those function portions are realized by hardware including, for example, a processor, a clock circuit, a communication circuit, a memory device, a digital input/output circuit, an analog input/output circuit, a power electronics circuit, and the like, and a program for realizing various functions in cooperation with those hardware.

The flame determining portion 111 determines whether a stable flame is generated by the corresponding burner, or not, based on the flame detection signal output from a corresponding one of the flame detectors 23_1 to 23_4. For example, when a flame detection signal indicating that a flame is present is output from a corresponding one of the flame detectors 23_1 to 23_4 during the combustion in the combustion furnace 2, the flame determining portion 111 determines that a stable flame occurs by the corresponding burner. On the other hand, if a flame detection signal indicating that there is no flame is output during the combustion in the combustion furnace 2, the flame determining portion 111 determines that the corresponding burner has caused a flame failure. The determination result of the flame determining portion 111 is output to the signal outputting portion 122 and also output to the safety controlling device 10.

The signal outputting portion 122 is a function portion for outputting the normal combustion signal SB input from an outside (the master device 11 or another slave device) to a subsequent device (the slave device or the transmission line 13) based on the determination result of the flame determining portion 111. Specifically, when it is determined by the flame determining portion 111 that there is a flame after the corresponding burner 21 has been ignited, the signal outputting portion 122 outputs the normal combustion signal SB input from the master device 11 or the slave device 12 connected to a preceding stage to a subsequent device. When it is determined by the flame determining portion 111 that there is no flame after the corresponding burner 21 has been ignited, the signal outputting portion 122 outputs no input normal combustion signal SB to the subsequent device.

As the signal outputting portion 122, a switch circuit that includes a switch element whose one end is connected to a preceding device (the master device 11 or the slave device 12) and the other end is connected to the subsequent device (the slave device 12 or the transmission line 13), and turns on/off the switch element based on the determination result of the flame determining portion 111 can be exemplified.

Therefore, when it is determined that there is a flame after the ignition of the corresponding one of the burners 21_1 to 21_3, the slave devices 12_1 to 12_3 excluding the cascade-connected final stage slave device 12_4 sequentially output the normal combustion signal SB to the slave devices 12_2 to 12_4 connected to the subsequent stage by the signal outputting portion 122. When it is determined that there is no flame after the ignition of the corresponding one of the burners 21_1 to 21_3, the slave devices 12_1 to 12_3 output no normal combustion signal SB to the slave devices 12_2 to 12_4 connected to the subsequent stage.

When the slave device 12_4 at the final stage determines that there is a flame after the corresponding burner 21_4 has been ignited, the signal outputting portion 122 outputs the normal combustion signal SB input from the slave device 12_3 connected at the preceding stage to the transmission line 13. When the slave device 12_4 determines that there is no flame after the corresponding burner 21_4 has been ignited, the signal outputting portion 122 outputs no input normal combustion signal SB to the transmission line 13.

The ignition controlling portion 114 is a function portion that controls ignition of the corresponding burner. For example, when it is determined by the flame determining portion 111 that there is no flame (pseudo flame) after receiving the combustion request from the safety controlling device 10, the ignition controlling portion 114 controls the corresponding one of the ignition devices 22_1 to 22_4 according to the ignition sequence, for example, a predetermined ignition sequence, to thereby ignite the corresponding one of the burners 21_1 to 21_4.

(Operation of Combustion Controlling System According to Examples)

Next, the operation of the combustion controlling system 100 during ignition control until the burner is ignited and the fired burner causes the flame failure will be described with reference to the drawings.

Figure 3:
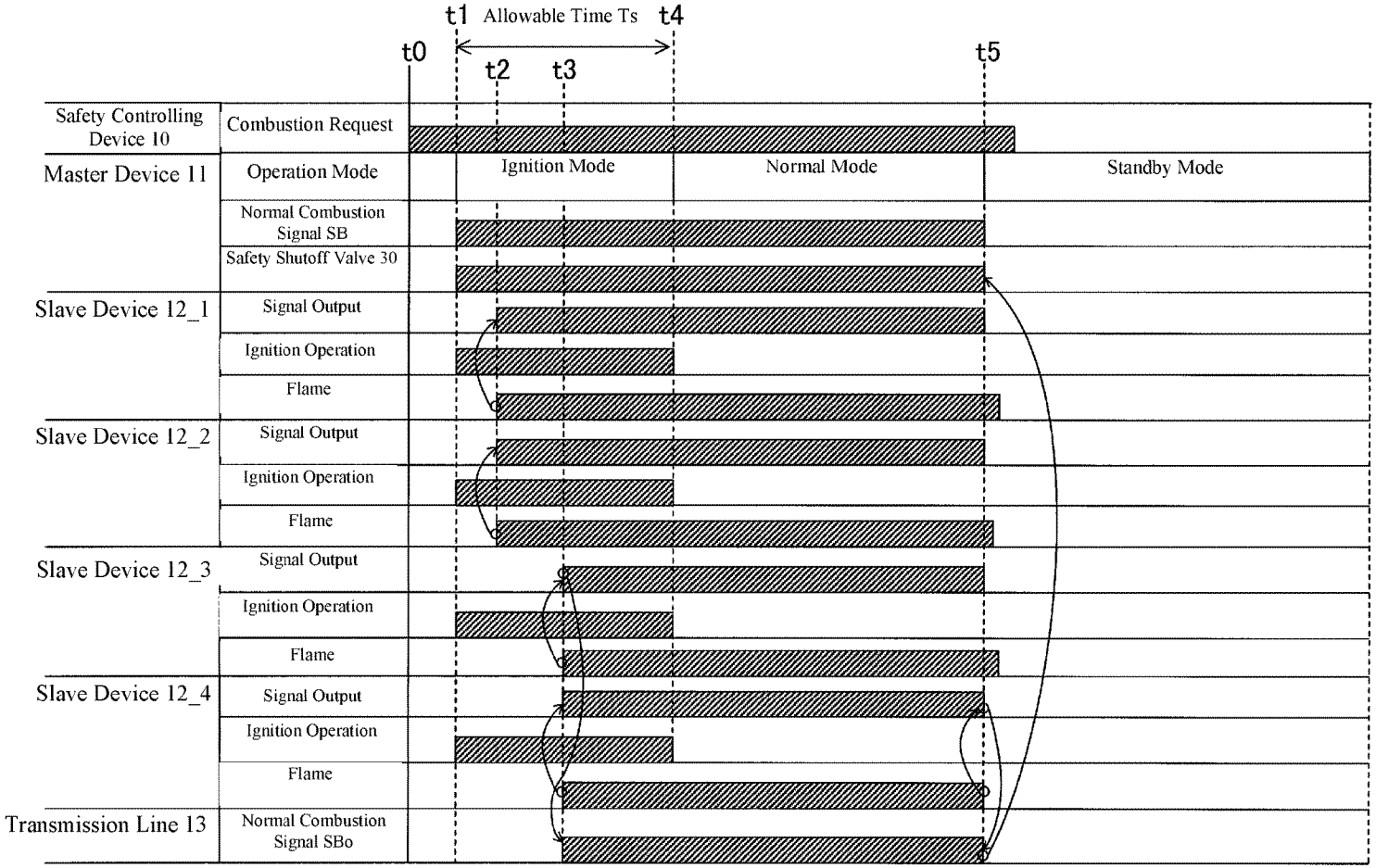
FIG. 3 is a diagram illustrating an operation flow of the combustion controlling system in the case where burners are ignited and one or some burners result in a flame failure after all of the burners have been fired according to the example.
Figure 4:
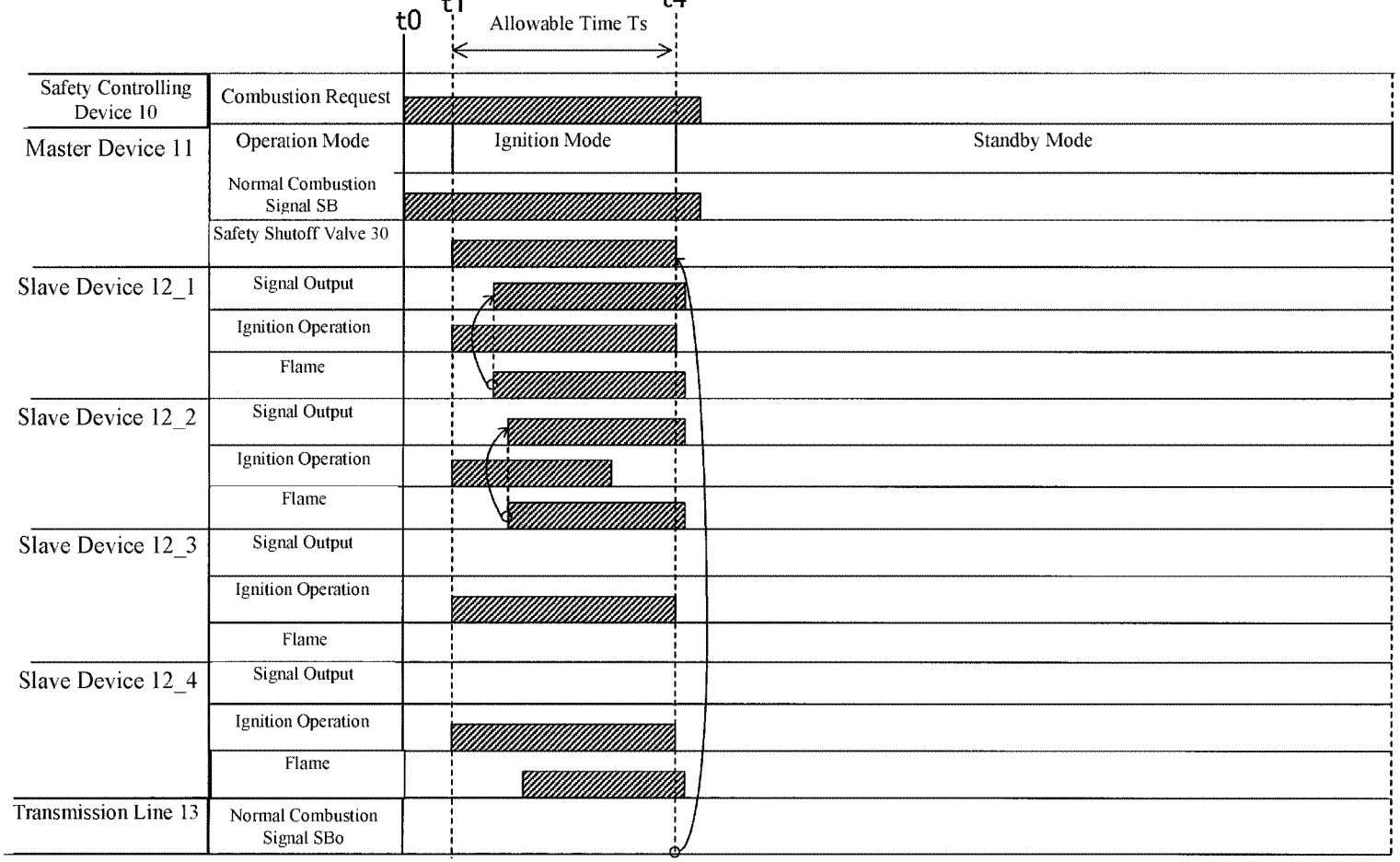
FIG. 4 is a diagram illustrating an operation flow of the combustion controlling system in the case where the burners are ignited and one or some burners have not normally been fired according to the example.

FIG. 3 is a diagram illustrating an operation flow of the combustion controlling system 100 in the case where burners are ignited and one or some burners result in a flame failure after all of the burners have been fired. FIG. 4 is a diagram illustrating an operation flow of the combustion controlling system 100 in the case where the burners are ignited and one or some burners have not normally been fired. FIGS. 5A to 5G are diagrams illustrating the operating states and the transmission states of the normal combustion signal SB in the master device 11 and the slave devices under the ignition control of the burners.

In FIGS. 3 and 4, a period during which the combustion request is output, a period during which the normal combustion signals SB and SBo are output, a period during which the safety shutoff valve 30 is open, a period during which the ignition operation is performed, and a period during which the flame is occurring are indicated by hatching.

First, a flow of operation of the combustion controlling system 100 in the case where burners are ignited and one or some burners result in a flame failure after all of the burners have been fired will be described.

Figure 5A:
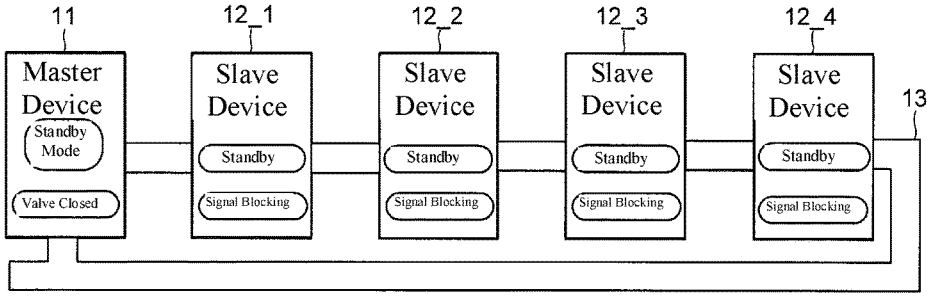
FIG. 5A is a diagram illustrating operating states and transmission states of a normal combustion signal in a master device and slave devices under an ignition control of the burners.
Figure 5B:
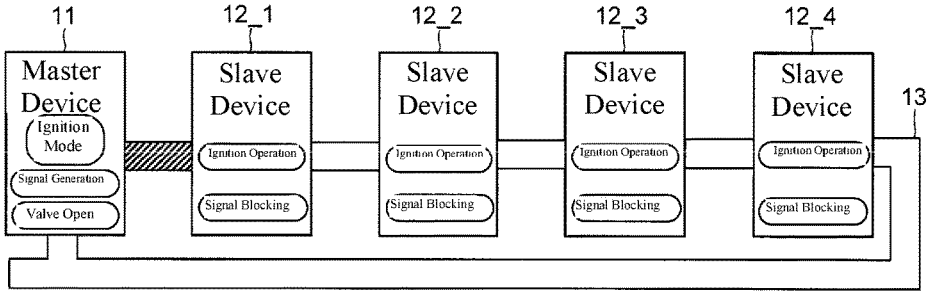
FIG. 5B is a diagram illustrating the operating states and the transmission states of the normal combustion signal in the master device and the slave devices under the ignition control of the burners.
Figure 5C:
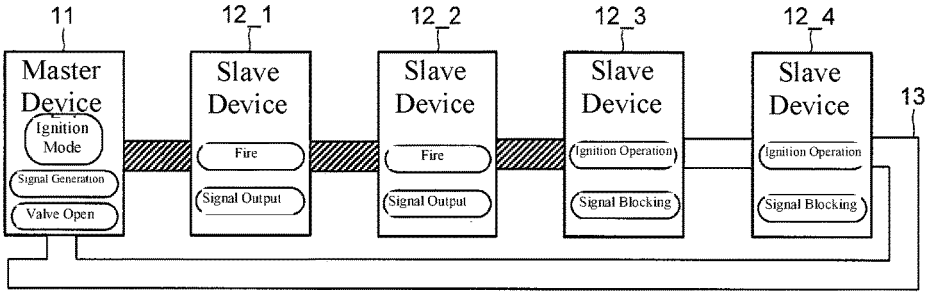
FIG. 5C is a diagram illustrating the operating states and the transmission states of the normal combustion signal in the master device and the slave devices under the ignition control of the burners.
Figure 5D:
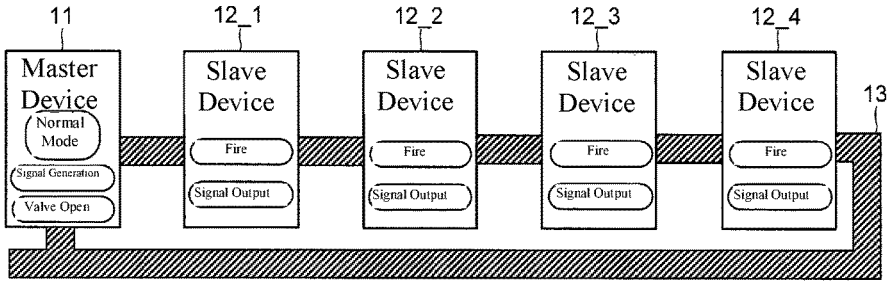
FIG. 5D is a diagram illustrating the operating states and the transmission states of the normal combustion signal in the master device and the slave devices under the ignition control of the burners.
Figure 5E:
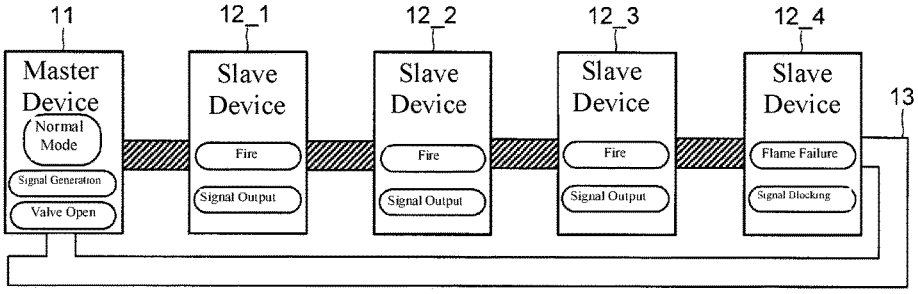
FIG. 5E is a diagram illustrating the operating states and the transmission states of the normal combustion signal in the master device and the slave devices under the ignition control of the burners.

As illustrated in FIG. 3, for example, at a time t0 at which the master device 11 is in the standby mode, closes the safety shutoff valve 30, and outputs no normal combustion signal SB, it is assumed that the combustion request is output from the safety controlling device 10 to the master device 11 and the respective slave devices 12 (refer to FIG. 5A).

Upon receiving the combustion request, the master device 11 and each of the slave devices 12_1 to 12_4 start predetermined ignition preparations such as prepurge or determination processing such as presence or absence of false flame. At a time t1 after completion of the ignition preparations, the master device 11 opens the safety shutoff valve 30 and generates a pulse by the signal generating portion 112, outputs the generated pulse as a normal combustion signal SB to the slave device 12_1 at the subsequent stage, and the slave devices 12_1 to 12-4 start an ignition operation (refer to FIG. 5B). At that time, the master device 11 switches the control mode from the standby mode to the ignition mode by the control mode setting portion 117, sets the allowable time Ts in the timer 116 by the safety shutoff valve controlling portion 115, and starts counting with the timer 116.

Thereafter, for example, at a time t2, it is assumed that the burners 21_1 and 21_2 are fired, and the slave devices 12_1 and 12_2 determine that there are flames of the respective burners 21_1 and 21_2. In that case, the slave device 12_1 outputs the normal combustion signal SB input from the master device 11 to the subsequent slave device 12_2 and the slave device 12_2 outputs the normal combustion signal SB supplied from the slave device 12_1 to the slave device 12_3 at the subsequent stage (refer to FIG. 5C). At that time, since the slave devices 12_3 and 12_4 are in the ignition operation and ignition cannot be confirmed, the normal combustion signal SB is not transmitted to the transmission line 13.

Next, for example, at a time t 3, it is determined that the burners 21_3 and 21_4 are fired and the slave devices 12_3 and 12_4 determine that there are the flames of the respective burners 21_3 and 21_4. In that case, the slave device 12_3 outputs the normal combustion signal SB input from the slave device 12_2 to the subsequent slave device 12_4, and the slave device 12_4 outputs the normal combustion signal SB supplied from the slave device 12_3 to the subsequent transmission line 13. As a result, the normal combustion signal SBo is input from the transmission line 13 to the master device 11, and the master device 11 detects the input of the normal combustion signal SBo by the signal detecting portion 113.

At a time t4, when the master device 11 detects that the count of the allowable time Ts is completed by the timer 116, the master mode device 11 switches the control mode from the ignition mode to the normal mode by the control mode setting portion 117, and keeps the safety shutoff valve 30 open by the safety shutoff valve controlling portion 115. As a result, the combustion in the combustion furnace 2 is continued (refer to FIG. 5D).

Thereafter, for example at a time t5, it is assumed that the burner 21_4 has caused a flame failure for some reason. In this case, the flame determining portion 111 of the slave device 12_4 determines that there is no flame based on the flame detection signal from the flame detector 23_4, and the signal outputting portion 122 of the slave device 12_4 stops the output of the normal combustion signal SB in response to the determination result (refer to FIG. 5E). As a result, the normal combustion signal SB is not transmitted to the transmission line 13, and the master device 11 cannot detect the input of the normal combustion signal SBo from the transmission line 13. For that reason, the master device 11 closes the safety shutoff valve 30 by the safety shutoff valve controlling portion 115, and switches the control mode from the normal mode to the standby mode by the control mode setting portion 117.

Figure 5F:
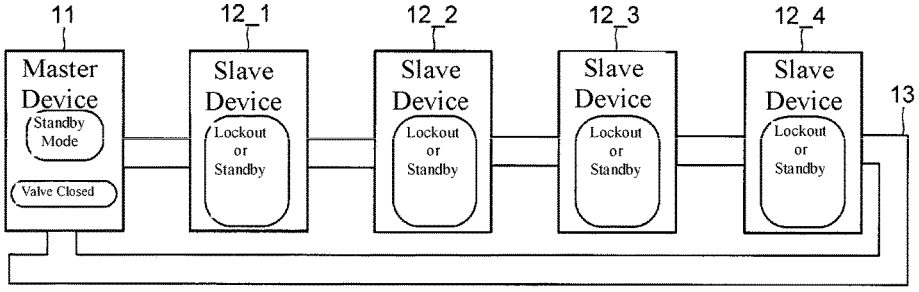
FIG. 5F is a diagram illustrating the operating states and the transmission states of the normal combustion signal in the master device and the slave devices under the ignition control of the burners.
Figure 5G:
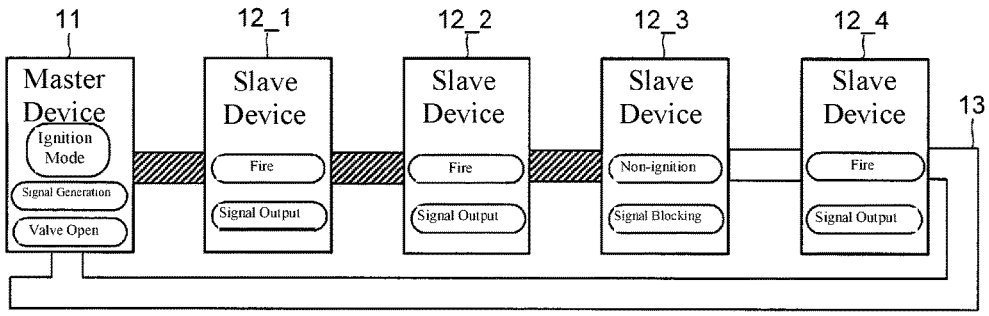
FIG. 5G is a diagram illustrating the operating states and the transmission states of the normal combustion signal in the master device and the slave devices under the ignition control of the burners.

Thereafter, the slave devices 12_1 to 12_4 are put into the standby state or a locked-out state in response to withdrawal of the combustion request by the safety controlling device 10 notified of the flame failure of the burner 21_4 (refer to FIG. 5F).

Next, a flow of the operation of the combustion controlling system 100 in the case where one or some of the burners have not been normally fired will be described with reference to FIG. 4.

As in the operation flow of FIG. 3 described above, when the master device 11 receives the combustion request through the safety controlling device 10 at the time t0, the master device 11 generates and outputs the normal combustion signal SB. At the time t1, the master device 11 opens the safety shutoff valve 30, and the slave devices 12_1 to 12_4 start the ignition operation. At that time, the master device 11 switches the control mode from the standby mode to the ignition mode by the control mode setting portion 117, sets the allowable time Ts in the timer 116 by the safety shutoff valve controlling portion 115, and starts counting with the timer 116.

Thereafter, for example, it is assumed that the burners 21_1, 21_2 and 21_4 are fired and only the burner 21_3 is not fired. In that case, the normal combustion signal SB output from the master device 11 is transmitted to the slave device 12_3 because the slave device 12_3 outputs no normal combustion signal SB, but the normal combustion signal SB is not transmitted to the subsequent slave device 12_4 and the transmission line 13 (refer to FIG. 5G).

Figure 5H:
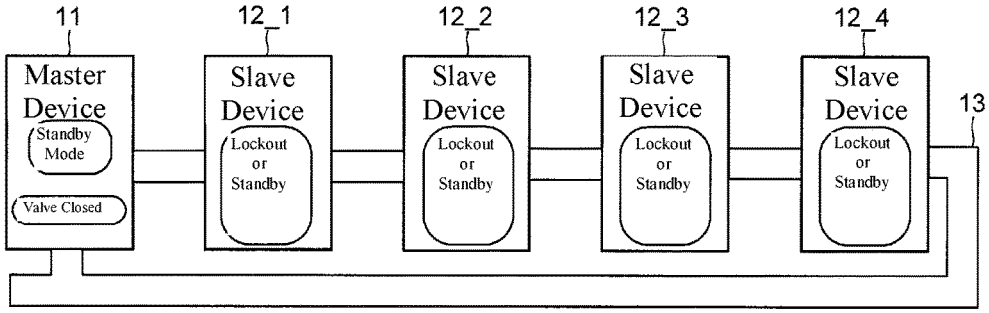
FIG. 5H is a diagram illustrating the operating states and the transmission states of the normal combustion signal in the master device and the slave devices under the ignition control of the burners.

At a time t4 when the allowable time Ts has elapsed, the master device 11 determines whether the input of the normal combustion signal SBo has been detected, or not, upon the detection that the count of the allowable time Ts has been completed by the timer 116. In that case, because the input of the normal combustion signal SBo cannot be detected by the signal detecting portion 113, the master device 11 switches the control mode from the ignition mode to the standby mode by the control mode setting portion 117, and closes the safety shutoff valve 30 by the safety shutoff valve controlling portion 115. Thereafter, the slave devices 12_1 to 12_4 are input into the standby state or the locked-out state in response to withdrawal of the combustion request by the safety controlling device 10 notified of the non-ignition of the burner 21_3 (refer to FIG. 5H).

(Advantages of Combustion Controlling System According to Examples)

As described above, according to the combustion controlling system of the present invention, the safety shutoff valve can be closed within a flame extinction safety time even if any one of the burners has caused the flame failure during combustion of the plurality of burners.

In other words, the combustion controlling system 100 according to the example provides a signal path for transmitting the normal combustion signal SB output from the master device 11 to the transmission line 13 through the cascade-connected slave devices 12_1 to 12_4. Then, the combustion controlling system 100 determines whether each of the slave devices 12_1 to 12_4 outputs the normal combustion signal SB to the subsequent device based on whether there is a flame of the corresponding burner, or not, during the combustion of the burners 21_1 to 21_4, and the master device 11 closes the safety shutoff valve 30 on the condition that the input of the normal combustion signal SBo from the transmission line 13 is stopped. As a result, even when one of the burners 21 has caused the flame failure during the combustion of the plurality of burners 21_1 to 21_4, the safety shutoff valve 30 can be promptly closed.

As described above, according to the combustion controlling system 100 of the example, as compared with the conventional multi-burner system in which a communication between the slave device 12 that has detected the flame failure and the master device 11 is performed through the safety controlling device 10 at the time of burner flame failure, the responsiveness of the control to the safety control valve at the time of the burner flame failure can be improved because a time lag does not easily occur before stoppage of all the burners after detection of the flame failure. As a result, the safety shutoff valve can be closed within the flame extinction safety time, and the safety standard can be satisfied.

Further, according to the combustion controlling system 100 of the example, when there is no input of the normal combustion signal SBo from the transmission line within the allowable time Ts (ignition time) at the time of igniting the burner 21, the master device 11 closes the safety shutoff valve 30. When the normal combustion signal SBo is input from the transmission line within the allowable time Ts, the master device 11 keeps safety shutoff valve 30 open. As a result, an unburned gas can be prevented from flowing into the combustion chamber 20 after the ignition period has elapsed at the time of non-ignition of the burner, and the combustion can be continued when the burner normally ignites.

ANOTHER EXAMPLE (Configuration of Combustion Controlling System According to Another Example)

Figure 6:
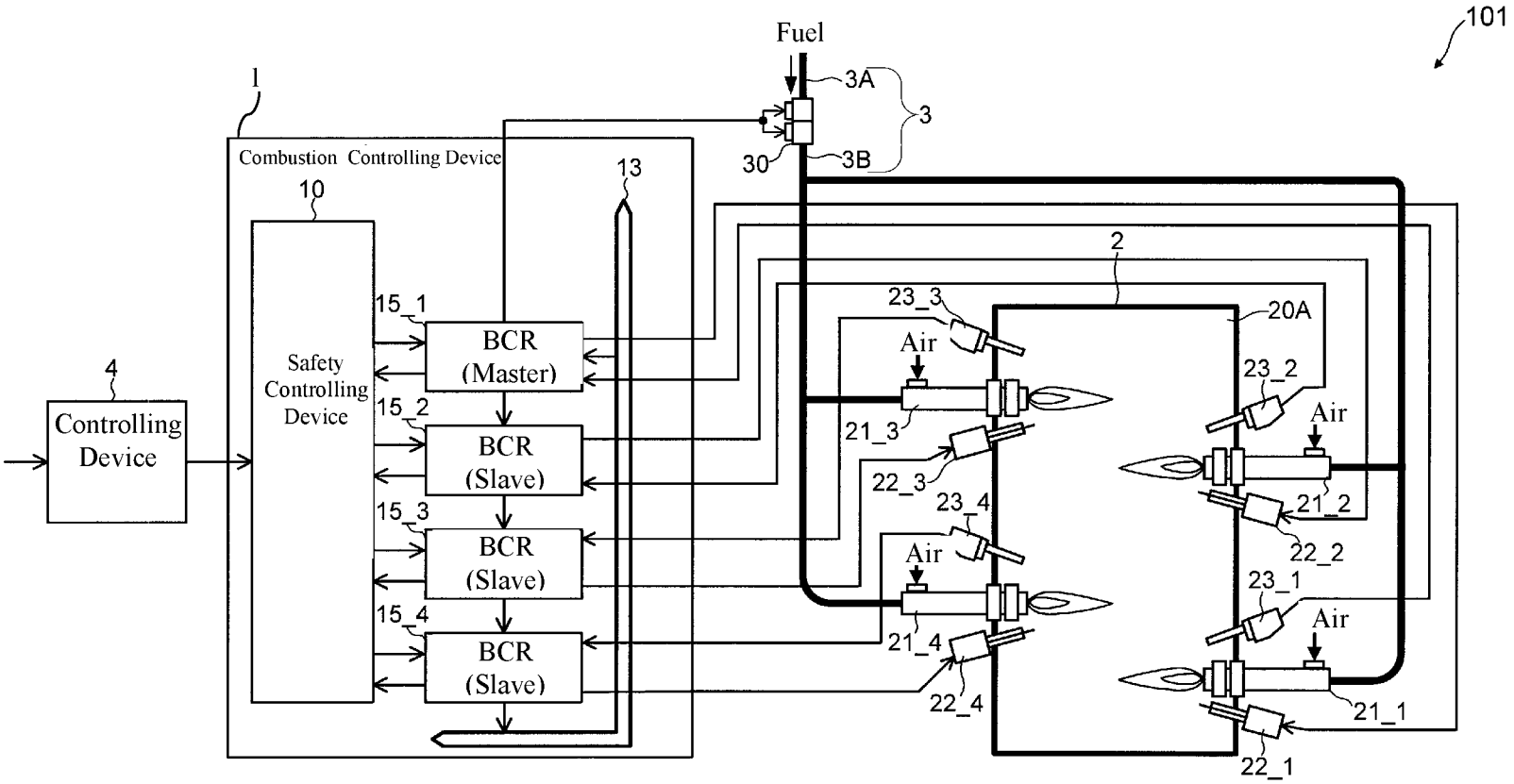
FIG. 6 is a diagram illustrating a configuration of a combustion controlling system according to another example.

FIG. 6 is a diagram illustrating a configuration of a combustion controlling system according to another example.

A combustion controlling system 101 illustrated in FIG. 6 differs from the combustion controlling system 100 according to the example in that one of the plurality of burner controllers functions as a master device for controlling the opening and closing of the safety shutoff valve.

Specifically, the combustion controlling system 101 has a plurality of burner controllers (BCR) 15_1 to 15_4 provided corresponding to the respective burners 21_1 to 21_4. The burner controller 15_1 functions as a master device for controlling the combustion of the corresponding burner, for generating the normal combustion signal SB, and for controlling the safety shutoff valve 30, and the burner controllers 15_2 to 15_4 function as slave devices for controlling combustion of the respective burners 21_1 to 21_4.

Figure 7:
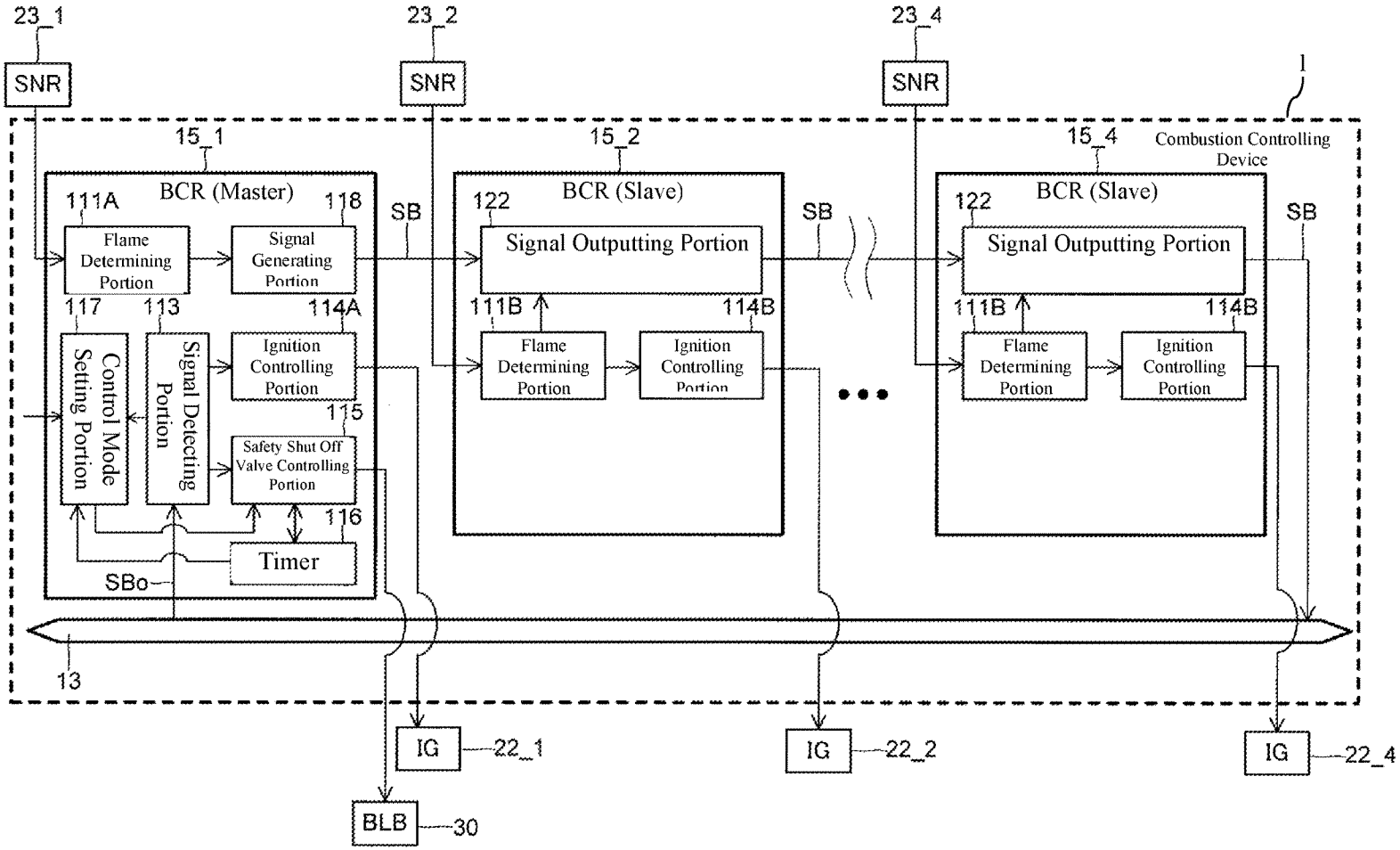
FIG. 7 is a diagram illustrating a configuration of a master device and a slave device in the combustion controlling system according to the other example.

FIG. 7 is a diagram illustrating an internal configuration of a burner controller in a combustion controlling system according to another example.

Among the components of the combustion controlling system 101 according to the other example, the same components as in the combustion controlling system 100 according to the example are designated by the same reference numerals and their detailed description will be omitted.

In the other example, for convenience of description, a flame determining portion and an ignition controlling portion of the burner controller 15_1 as the master device are denoted with reference numerals "111A" and "114A", and frame determining portions and ignition controlling portions of the burner controllers 15_2 to 15_4 as the slave devices are denoted by reference numerals "111B" and "114B".

As illustrated in FIG. 7, the burner controller 15_1 functioning as the master device includes a flame determining portion 111A, a signal generating portion 118, the signal detecting portion 113, the timer 116, the control mode setting portion 117, an ignition controlling portion 114A, and a safety shutoff valve controlling portion 115.

The flame determining portion 111A determines whether a stable flame is generated by the burner 21_1, or not, based on the flame detection signal output from the flame detector 23_1. The flame determination method by the flame determining portion 111A is similar to the flame determining portion 111 according to the example. The determination result of the flame determining portion 111A is output to the signal generating portion 118 and also output to the safety controlling device 10.

The signal generating portion 118 generates the normal combustion signal SB based on the determination result of the flame determining portion 111A. Specifically, when it is determined by the flame determining portion 111A that there is a flame of the burner 21_1, the signal generating portion 118 generates the normal combustion signal SB and outputs the generated normal combustion signal SB to the burner controller 15_2. When it is determined by the flame determining portion 111A that there is no flame of the burner 21_1, the signal generating portion 118 generates no normal combustion signal SB.

The ignition controlling portion 114A is a function portion that controls the ignition of the burner 21_1 based on the detection result of the signal detecting portion 113. Specifically, when the signal detecting portion 113 detects the input of the normal combustion signal SBo, the ignition controlling portion 114A ignites the burner 21_1 by controlling the ignition device 22_1 according to, for example, a predetermined ignition sequence.

As with the slave devices 12_2 to 12_4 in the example, each of the burner controllers 15_2 to 15_4 includes a signal outputting portion 122, a flame determining portion 111B, and an ignition controlling portion 114B. The flame determining portion 111B and the ignition controlling portion 114B have the same configuration as the flame determining portion 111 and the ignition controlling portion 114 in the example.

(Operation of Combustion Controlling System According to the Other Example)

Next, the operation of the combustion controlling system 101 during ignition control of the burner will be described with reference to the drawings.

Figure 8:
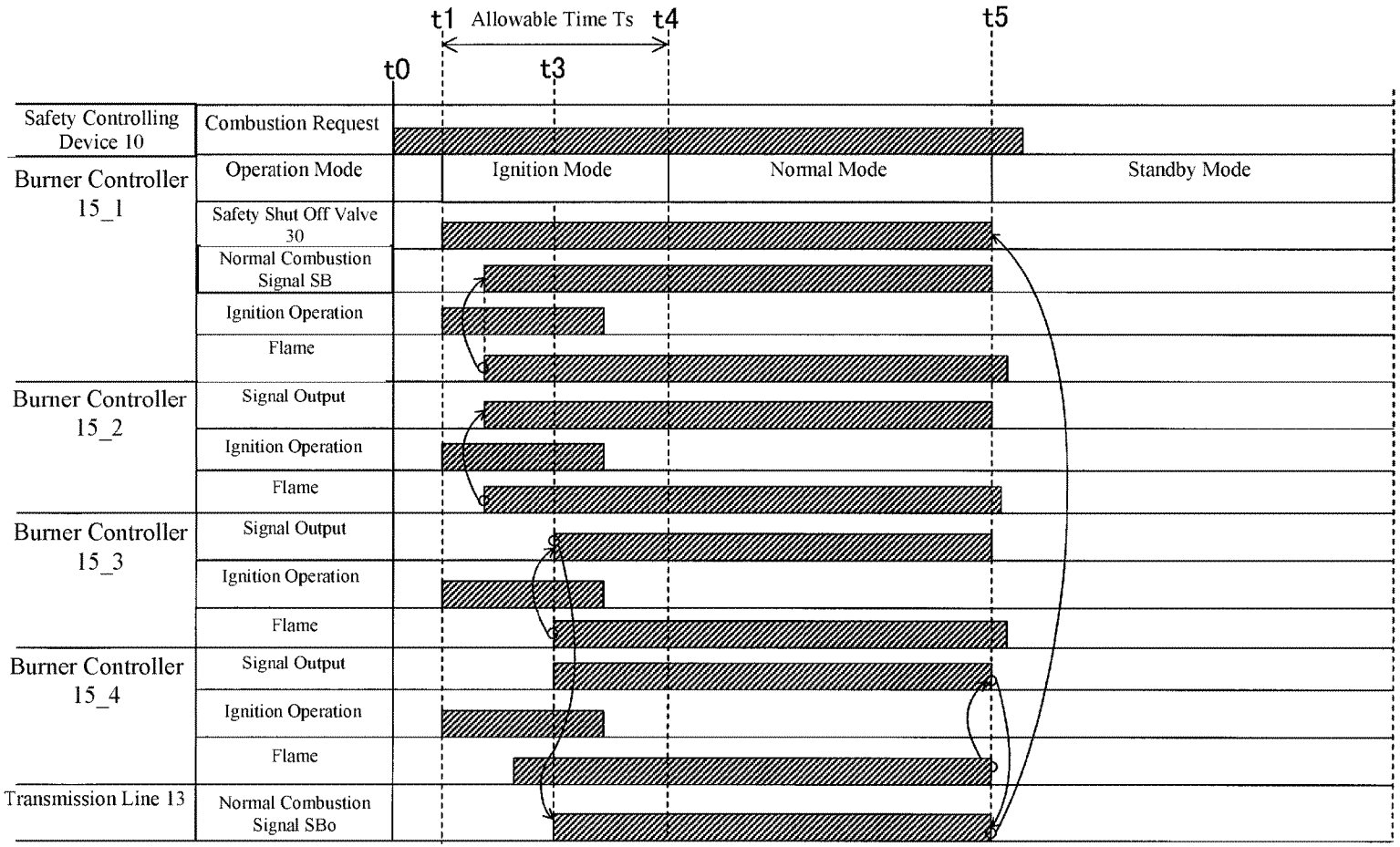
FIG. 8 is a diagram illustrating an operation flow of a combustion controlling system in the case where burners are ignited and one or some burners result in a flame failure after all of the burners have been fired according to the other example.
Figure 9:
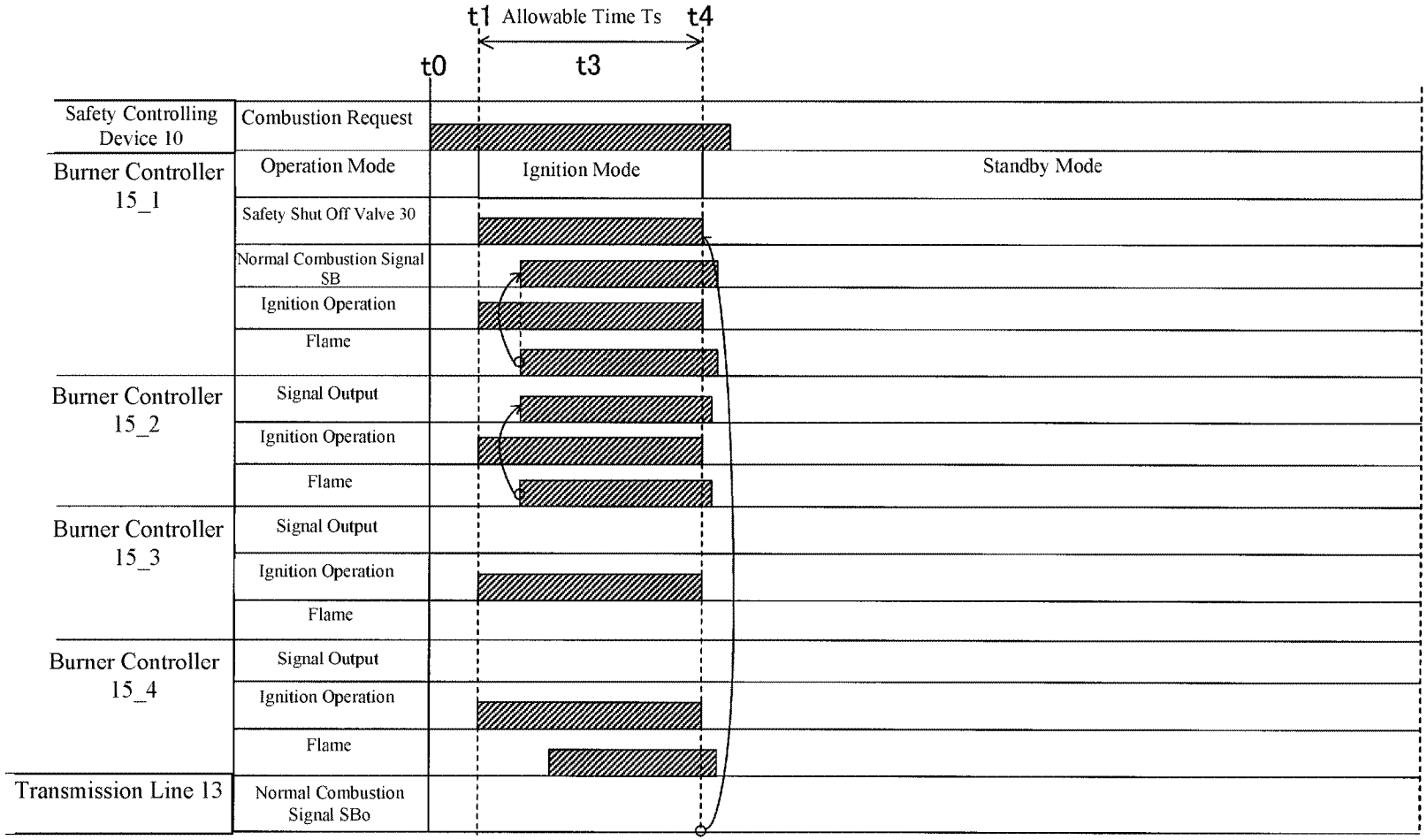
FIG. 9 is a diagram illustrating an operation flow of the combustion controlling system in the case where the burners are ignited and one or some burners have not normally been fired according to the other example.

FIG. 8 is a diagram illustrating an operation flow of the combustion controlling system 101 in the case where burners are ignited and one or some burners result in a flame failure after all of the burners have been fired. FIG. 9 is a diagram illustrating an operation flow of the combustion controlling system 101 in the case where the burners are ignited and one or some burners have not normally been fired.

First, a flow of operation of the combustion controlling system 101 in the case where burners are ignited and one or some burners result in a flame failure after all of the burners have been fired will be described.

As illustrated in FIG. 8, it is assumed that the combustion request is output from the safety controlling device 10 to the master device and each of the slave devices, for example, at the time t0. At that time, the burner controller 15_1 as the master device generates the normal combustion signal SB by the aid of the signal generating portion 118, for example, in a state where the safety shutoff valve 30 is closed, and outputs the generated normal combustion signal SB to the slave device 15_2 at the subsequent stage.

Next, upon receiving the combustion request, each of the burner controllers 15_1 to 15_4 performs predetermined ignition preparations such as prepurge or determination processing such as presence or absence of false flame. Then, at the time t1 after completion of the ignition preparations, the burner controller 15_1 opens the safety shutoff valve 30 to start the ignition operation, and the burner controllers 15_2 to 15_4 also start the ignition operation. At that time, the burner controller 15_1 switches the control mode from the standby mode to the ignition mode by the control mode setting portion 117, sets the allowable time Ts in the timer 116 by the safety shutoff valve controlling portion 115, and starts counting with the timer 116.

Thereafter, for example, at the time t3, if all of the burners 21_1 to 21_4 have been fired, the normal combustion signal SB output from the burner controller 15_1 is transmitted to the transmission line 13 and input again to the master device 15_1 from the transmission line 13.

At a time t4, when the burner controller 15_1 detects that the count of the allowable time Ts is completed by the timer 116, the burner controller 15_1 switches the control mode from the ignition mode to the normal mode by the control mode setting portion 117, and keeps the safety shutoff valve 30 open by the safety shutoff valve controlling portion 115. As a result, the combustion in the combustion furnace 2 is continued.

Thereafter, for example at a time t5, it is assumed that the burner 21_4 has caused a flame failure for some reason. In this case, the flame determining portion 111B of the burner controller 15_4 determines that there is no flame based on the flame detection signal from the flame detector 23_4, and the signal outputting portion 122 of the burner controller 15_4 stops the output of the normal combustion signal SB in response to the determination result. As a result, the normal combustion signal SB is not transmitted to the transmission line 13, and the burner controller 15_1 cannot detect the input of the normal combustion signal SBo from the transmission line 13. For that reason, the burner controller 15_1 closes the safety shutoff valve 30 by the safety shutoff valve controlling portion 115, and switches the control mode from the normal mode to the standby mode by the control mode setting portion 117.

Thereafter, the slave devices 15_2 to 15_4 are put into the standby state or a locked-out state in response to withdrawal of the combustion request by the safety controlling device 10 notified of the flame failure of the burner 21_4.

Next, a flow of the operation of the combustion controlling system 101 in the case where one or some of the burners have not been normally fired will be described with reference to FIG. 9.

As in the operation flow of FIG. 3 described above, when the burner controller 15_1 functioning as the master device 11 receives the combustion request through the safety controlling device 10 at the time t0, the burner controller 15_1 generates and outputs the normal combustion signal SB. At the time t1, the burner controller 15_1 opens the safety shutoff valve 30 and starts the ignition operation, and the burner controllers 15_2 to 15_4 also start the ignition operation. At that time, similarly to the master device 11, the burner controller 15_1 switches the control mode from the standby mode to the ignition mode and starts counting the allowable time Ts.

Thereafter, for example, it is assumed that the burners 21_1, 21_2 and 21_4 are fired and only the burner 21_3 is not fired. In that case, the normal combustion signal SB output from the burner controller 15_1 is transmitted to the burner controller 15_3 because the burner controller 15_3 outputs no normal combustion signal SB, but the normal combustion signal SB is not transmitted to the subsequent burner controller 15_4 and the transmission line 13.

At a time t4 when the allowable time Ts has elapsed, the burner controller 15_1 determines whether the input of the normal combustion signal SBo has been detected, or not, upon the detection that the count of the allowable time Ts has been completed by the timer 116. In that case, because the input of the normal combustion signal SBo cannot be detected by the signal detecting portion 113, the burner controller 15_1 switches the control mode from the ignition mode to the standby mode and closes the safety shutoff valve 30 as with the master device 11. Thereafter, the burner controllers 15_1 to 15_4 are input into the standby state or the locked-out state in response to withdrawal of the combustion request by the safety controlling device 10 notified of the non-ignition of the burner 21_3.

(Advantages of Combustion Controlling System According to the Other Example)

As described above, according to the combustion controlling system 101 according to the other example, as with the combustion controlling system 100 according to the example, the responsiveness of the control to the safety shutoff valve at the time of the burner flame failure and at the time of burner non-ignition can be improved.

Further, according to the combustion controlling system 101, the burner controller corresponding to each burner is provided, and one of the burner controllers is made to function as a master device for controlling the opening and closing of the safety shutoff valve, as a result of which with a simpler device configuration, the safety standard related to the flame extinction safety time can be satisfied.

As described above, the invention implemented by the inventors and the like has been described specifically based on the example. However, the invention is not limited to the example and it will be appreciated that various modifications can be made without departing from the scope of the invention.

For example, in the above examples, the cases where the combustion furnace 2 of the combustion controlling systems 100 and 101 has one combustion chamber 20 have been exemplified. Alternatively, a plurality of combustion chambers may be provided. In that case, the main flow channel 3A, the branch flow channel 3B, the safety shutoff valve 30, and the combustion controlling device 1 may be provided for each combustion chamber, and each of the combustion controlling devices 1 may control the opening and closing of the corresponding safety shutoff valve 30.

In addition, in the above examples, the cases in which the burners 21_1 to 21_4 are burners of the direct ignition type which directly ignite the main burner without the provision of the pilot burner. Alternatively, the burners 21_1 to 21_4 may be configured by a burner of a timed pilot ignition type having the pilot burner and the main burner.

What is claimed is:

1. A combustion controlling system comprising:

a master device that controls opening and closing of a common safety shutoff valve collectively switching supply and shutoff of a fuel to a plurality of burners and generates a predetermined signal;

a plurality of slave devices provided corresponding to the respective burners, determine whether there is a flame in the respective burners, control an ignition of the respective burners, and output the input predetermined signal when it is determined that there is the flame after the ignition of the respective burners, and output no input predetermined signal when it is determined that there is no flame after the ignition of the respective burners; and a transmission line connected to the master device transmitting the predetermined signal, wherein the plurality of slave devices are connected in cascade, when all of the plurality of slave devices determine that there is the flame after the ignition of the respective burners, the predetermined signal input to an initial-stage slave device from the master device are sequentially output and the predetermined signal is output from a final-stage slave device to the transmission line, when any one of the plurality of cascaded slave devices determines that there is no flame after the ignition of the respective burners, the predetermined signal is not output from the final-stage slave device to the transmission line, and the master device controls opening and closing of the safety shutoff valve based on whether the predetermined signal is input from the transmission line.

2. The combustion controlling system according to claim 1, wherein the master device closes the safety shutoff valve when the input of the predetermined signal is stopped from a state where the predetermined signal is input from the transmission line.

3. The combustion controlling system according to claim 2, wherein in the case where the burners are ignited from a state in which none of the burners is ignited, the master device closes the safety shutoff valve when the predetermined signal is not input from the transmission line within a predetermined period after the safety shutoff valve has been opened, and keeps the safety shutoff valve open when the predetermined signal is input from the transmission line within the predetermined period.

4. The combustion controlling system according to claim 1, further comprising: a burner whose combustion is controlled by the master device, wherein the master device outputs the predetermined signal to the initial-stage slave device connected in cascade when it is determined that there is the flame after the burner to be controlled has been ignited, and does not output the predetermined signal when it is determined that there is no flame after the burner to be controlled has been ignited.

5. The combustion controlling system according to claim 1, wherein the master device comprises:

a first flame determiner determines whether there is a flame of the burner to be controlled, or not;

a signal generator generates and outputs the predetermined signal when it is determined that there is the flame by the first flame determining portion and generates no predetermined signal when it is determined that there is no flame by the first flame determining portion;

a signal detector detects an input of the predetermined signal from the transmission line;

a control mode setter switches a control mode of the burner between an ignition mode for igniting the burner from a state in which none of the burners is fired and a normal mode in which the burner is normally fired;

a timer that counts an allowable time during which fuel can be supplied to the burners; and a safety shutoff valve controller controls the opening and closing of the safety shutoff valve based on a detection result of the signal detecting portion and the control mode, and when the ignition mode is set, the safety shutoff valve controlling portion closes the safety shutoff valve after the allowable time has elapsed if the input of the predetermined signal is not detected by the signal detecting portion until the allowable time elapses after the safety shutoff valve has been opened, and keeps the safety shutoff valve open if the input of the predetermined signal is detected by the signal detecting portion until the allowable time elapses.

6. The combustion controlling system according to claim 5, wherein when the safety shutoff valve controller closes the safety shutoff valve without waiting for the allowable time to elapse if the input of the predetermined signal is not detected by the signal detecting portion when the normal mode is set.

7. The combustion controlling system according to claim 5, wherein the slave device comprises:

a second flame determiner determines whether there is a flame of the corresponding burner, or not;

a signal output outputs the input predetermined signal if it is determined that there is the flame by the second flame determining portion and outputs no input predetermined signal if it is determined that there is no flame by the second flame determining portion; and an ignition controller controls ignition of the corresponding burner based on a determination result of the second flame determining portion.

* * * * *